US008543319B2

(12) United States Patent
Kawauchi et al.

(10) Patent No.: US 8,543,319 B2
(45) Date of Patent: Sep. 24, 2013

(54) COMMUNICATION EQUIPMENT, INTER-VEHICLE COMMUNICATION CONTROL METHOD AND INTER-VEHICLE COMMUNICATION SYSTEM

(75) Inventors: Takashi Kawauchi, Kodaira (JP); Yuki Horita, Tokyo (JP); Tatsuaki Osafune, Kawasaki (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 62 days.

(21) Appl. No.: 13/105,886

(22) Filed: May 11, 2011

(65) Prior Publication Data

US 2011/0282566 A1 Nov. 17, 2011

(30) Foreign Application Priority Data

May 12, 2010 (JP) ..... 2010-110050
Apr. 21, 2011 (WO) ..... PCT/JP2011/059809

(51) Int. Cl.
*G06G 7/76* (2006.01)
*G08G 1/00* (2006.01)

(52) U.S. Cl.
USPC ..... 701/117; 340/903

(58) Field of Classification Search
USPC ..... 701/117; 340/903
See application file for complete search history.

(56) References Cited

U.S. PATENT DOCUMENTS

| | | | | |
|---|---|---|---|---|
| 7,046,168 | B2 * | 5/2006 | Tsuboi | 340/903 |
| 7,486,202 | B2 * | 2/2009 | Konishi et al. | 340/932 |
| 7,577,514 | B2 * | 8/2009 | Nakaoka | 701/119 |
| 7,804,395 | B2 * | 9/2010 | Muramatsu et al. | 340/435 |
| 2004/0236499 | A1 * | 11/2004 | Watanabe | 701/200 |
| 2005/0030202 | A1 | 2/2005 | Tsuboi | |
| 2007/0117525 | A1 | 5/2007 | Osafune | |
| 2011/0012756 | A1 * | 1/2011 | Yamamoto | 340/905 |

FOREIGN PATENT DOCUMENTS

| | | | |
|---|---|---|---|
| JP | 2005-12522 | A | 1/2005 |
| JP | 2007-143121 | A | 6/2007 |
| JP | 2008-11343 | A | 1/2008 |
| JP | 2008-197702 | A | 8/2008 |
| WO | WO 2007/023899 | A1 | 3/2007 |

OTHER PUBLICATIONS

International Search Report from International Application No. PCT/JP2011/059809.
International Preliminary Report on Patentability from International Application No. PCT/JP2011/059809.
English translation of International Search Report issued May 24, 2011, for International Application No. PCT/JP2011/059809.
English Translation of International Preliminary Report on Patentability for International Application No. PCT/JP2011/059809, issued Dec. 10, 2012.

* cited by examiner

*Primary Examiner* — Thomas Tarcza
*Assistant Examiner* — Tyler J Lee
(74) *Attorney, Agent, or Firm* — Miles & Stockbridge P.C.

(57) ABSTRACT

Communication equipment that received transfer data including data to be transferred, position information of a destination of the data to be transferred, position information of relay points used to determine a route to the destination, and position information of a last transferring vehicle determines a standby time that becomes shorter as a distance between the position of the last transferring vehicle and the position of a host vehicle becomes longer in the case where the host vehicle is not located in a predetermined range on the basis of the relay points. In addition, the communication equipment determines the standby time that becomes longer as a distance between the position of the host vehicle and the position of the relay point becomes longer in the case where the host vehicle is located in the predetermined range, and performs a process of transmitting the transfer data after the standby time passes.

9 Claims, 8 Drawing Sheets

Fig.6

| COUPLING POINT ID | COUPLING POINT LATITUDE INFORMATION 1 | COUPLING POINT LATITUDE INFORMATION 2 | COUPLING POINT LONGITUDE INFORMATION 1 | COUPLING POINT LONGITUDE INFORMATION 2 | POINT ID COUPLED TO COUPLING POINT | DISTANCE TO COUPLING POINT | | DISTANCE TO COUPLING POINT N | SIZE OF COUPLING POINT |
|---|---|---|---|---|---|---|---|---|---|
| 1 | 4807.038247 | N | 01131.324523 | E | 2,3,4 | 30 | | 40 | 5 |
| 2 | 4807.038248 | N | 01131.324524 | E | 1 | 30 | | | 4 |
| | | | | | | | | | |
| | | | | | | | | | |

Fig.7

| SOURCE VEHICLE ID | SERVICE TYPE ID | TRANSMISSION INFORMATION ID | SOURCE VEHICLE LATITUDE INFORMATION 1 | SOURCE VEHICLE LATITUDE INFORMATION 2 | SOURCE VEHICLE LONGITUDE INFORMATION 1 | MOVING DIRECTION OF SOURCE VEHICLE | VELOCITY OF SOURCE VEHICLE | POSITIONING TIME |
|---|---|---|---|---|---|---|---|---|
| 1000 | 1 | 1919 | 4807.038247 | N | 01131.324523 | 60 | 60 | 12:35:19.00 |

50

| DESTINATION RANGE LATITUDE INFORMATION 1 | DESTINATION RANGE LATITUDE INFORMATION 2 | DESTINATION RANGE LONGITUDE INFORMATION 1 | DESTINATION RANGE LONGITUDE INFORMATION 2 | SIZE OF DESTINATION RANGE | DIAGRAM OF DESTINATION RANGE |
|---|---|---|---|---|---|
| 4807.038248 | N | 01131.324524 | E | 5 | circle |

51

| TRANSFERRING VEHICLE ID | TRANSFERRING VEHICLE LATITUDE INFORMATION 1 | TRANSFERRING VEHICLE LATITUDE INFORMATION 2 | TRANSFERRING VEHICLE LONGITUDE INFORMATION 1 | TRANSFERRING VEHICLE LONGITUDE INFORMATION 2 |
|---|---|---|---|---|
| 999 | 4807.038249 | N | 01131.324525 | E |

52

| LATITUDE INFORMATION 1 OF RELAY POINT 1 | LATITUDE INFORMATION 2 OF RELAY POINT 1 | LONGITUDE INFORMATION 1 OF RELAY POINT 1 | LONGITUDE INFORMATION 2 OF RELAY POINT 1 | SIZE OF RELAY POINT 1 | | LATITUDE INFORMATION 1 OF RELAY POINT N | LATITUDE INFORMATION 2 OF RELAY POINT N | LONGITUDE INFORMATION 1 OF RELAY POINT N | LONGITUDE INFORMATION 2 OF RELAY POINT N | SIZE OF RELAY POINT N |
|---|---|---|---|---|---|---|---|---|---|---|
| 4807.038350 | N | 01131.324530 | E | 5 | | 4807.038251 | N | 01131.324532 | E | 5 |

53

| SERVICE TYPE ID | SERVICE TYPE |
|---|---|
| 1 | PROVISION OF POSITION INFORMATION OF EMERGENCY VEHICLE |
| 2 | PROVISION OF POSITION INFORMATION OF GENERAL VEHICLE |
| 3 | PROVISION OF POSITION INFORMATION OF BROKEN VEHICLE |

COMMUNICATION EQUIPMENT, INTER-VEHICLE COMMUNICATION CONTROL METHOD AND INTER-VEHICLE COMMUNICATION SYSTEM

CROSS-REFERENCE TO RELATED APPLICATIONS

The present application claims priority from Japanese patent application JP 2010-110050 filed on May 12, 2010, the content of which is hereby incorporated by reference into this application

BACKGROUND

The present invention relates to a technique for a service in which information related to road traffic is provided, and particularly to a technique useful for being applied to communication equipment (or a communication device), an inter-vehicle communication control method, and an inter-vehicle communication system by which information for indicating vehicle running conditions is transmitted and received.

In recent years, an intelligent transport system (ITS) has been widely spread for the purpose of safe-driving support for vehicles in road traffic and efficiency of road traffic. As one of services for supporting safe driving of vehicles in the ITS, there has been studied a service in which a vehicle having wireless communication equipment mounted receives traffic information such as position information of peripheral vehicles and traffic conditions from a roadside communication station installed on the side of a road or another vehicle having the wireless communication equipment mounted, and a warning is given to drivers to avoid a collision accident between vehicles. For example, the service is described as follows. The wireless communication equipment mounted in a vehicle periodically measures vehicle running information such as the position, moving direction and velocity of the host vehicle, and periodically transmits a vehicle running information packet. Then, another vehicle that received the vehicle running information packet calculates the possibility of collision using the received vehicle running information. In the case where it is determined on the basis of the calculation result that the possibility of collision is high, drivers are alerted by displaying a warning to urge them to stop the vehicles. However, such a service can be provided without a problem in a state where the wireless communication equipment of the source vehicle can directly communicate with that of the destination vehicle. However, in a state where vehicles are apart from each other, direct communications cannot be established and information cannot be transmitted in some cases. In such a case, a multihop communication system is employed so that the vehicle running information is transmitted to a destination while being relayed and transferred by vehicles and roadside base stations located between the source vehicle and the destination vehicle. As an example, Patent Documents 1 and 2 described later disclose a communication method using the multihop communication method.

The method disclosed in the Patent Document 1 is a method in which when information is transmitted to peripheral vehicles by broadcasting, peripheral vehicles located apart from the host vehicle are determined as relay vehicles on branched roads, and the transmission information is transferred by the relay vehicles to reduce the traffic volume and to transmit information to wide areas.

The method disclosed in the Patent Document 2 is a method in which the density of peripheral vehicles is calculated on the basis of the relative position obtained using position data including the positions, running velocities, and running directions of a transmission vehicle and a reception vehicle, and a time required for periodically transmitting vehicle running information is set in accordance with the density of vehicles to reduce the number of packets of the vehicle running information.

Patent Document 1

Japanese Unexamined Patent Publication No. 2005-12522

Patent Document 2

Japanese Unexamined Patent Publication No. 2007-143121

SUMMARY

In the case where communications are established with a vehicle located at a position where no radio waves directly reach, it is important to transmit information to a designated vehicle located even at a blind intersection or on a curved road. However, in the method described in the Patent Document 1, a vehicle located in a range where radio waves directly reach is designated as a relay vehicle, and thus the relay vehicle cannot be designated at a blind intersection or on a curved road in some cases. Further, even in the case where the relay vehicle can be designated, information cannot be transmitted from the relay vehicle in some cases if the relay vehicle is located near a blind intersection or a curve. Further, even in the method described in the Patent Document 2, efficient transmission of information at a blind intersection or on a curved road is not considered.

An object of the present invention is to provide communication equipment (or a communication device), an inter-vehicle communication control method, and an inter-vehicle communication system by which information can be efficiently transmitted to a designated range even at a blind intersection or on a curved road.

The above and other objects and novel features of the present invention will become apparent from the description and the accompanying drawings of the present specification.

The following is a summarized description of a representative aspect of the present invention disclosed in this application.

Specifically, communication equipment receives transfer data including data to be transferred, position information of a destination of the data to be transferred, position information of relay points used to determine a route to the destination, and position information of the last transferring vehicle. The communication equipment that received the transfer data calculates a predetermined standby time on the basis of the position of the host vehicle and the received transfer data, and performs a process of transmitting the transfer data after the standby time passes. The communication equipment calculates a time as the standby time that becomes shorter as a distance between the position of the last transferring vehicle and the position of the host vehicle becomes longer in the case where the host vehicle is not located in a predetermined range on the basis of the relay points. The communication equipment calculates a time as the standby time that becomes longer as a distance between the position of the host vehicle and the position of the relay point becomes longer in the case where the host vehicle is located in the predetermined range.

The following is a summarized effect obtained from the representative aspect of the present invention disclosed in this application. Specifically, information can be efficiently transmitted to a designated range even at a blind intersection or on a curved road by communication equipment, an inter-vehicle communication control method, and an inter-vehicle communication system.

BRIEF DESCRIPTION OF THE DRAWINGS

FIG. 6 is an explanation view for showing an example of a format of map information stored in a map information holding unit 1400;

FIG. 7 is an explanation view for showing an example of a packet format of vehicle information;

DETAILED DESCRIPTION

1. Summary of the Embodiments

Figure 1:
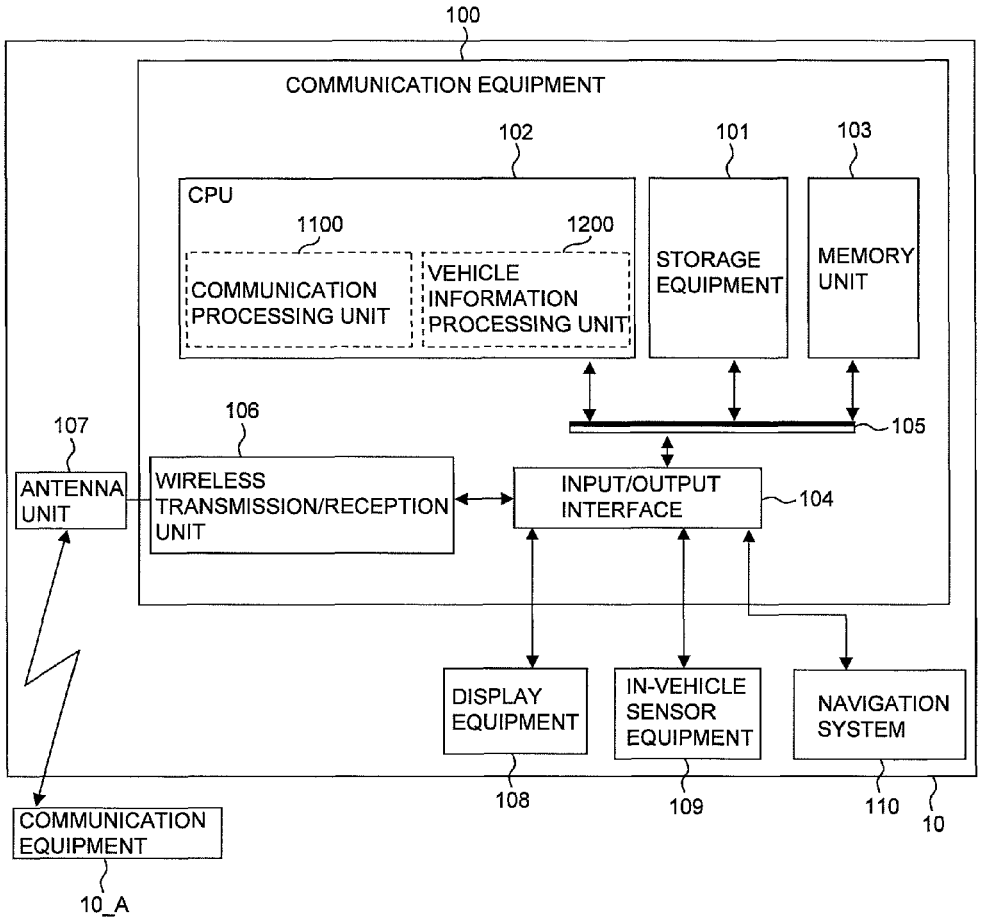
FIG. 1 is a block diagram for showing an example of an inter-vehicle communication system according to a first embodiment.

In the first place, general outlines of representative embodiments of the present invention disclosed in this application will be described. The referential signs in the drawings to be referred to while being in parentheses in the description of the general outlines of the representative embodiments merely illustrate constitutional elements within the concepts of those which are given the referential signs.

[1] (Transfer Standby Time is Determined on the Basis of Distance Between Relay Point and Host Vehicle in Relay Range)

Communication equipment (or a communication device) (100) according to a representative embodiment of the present invention includes a transmission/reception unit (1100) that receives transfer data for indicating vehicle running conditions and performs a process of transmitting the transfer data after a predetermined standby time passes, and a data processing unit (1200) that performs a process of calculating the predetermined standby time on the basis of the position of the host vehicle and the received transfer data. The transfer data for indicating the vehicle running conditions include data (50) to be transferred, position information (51) of a destination of the data to be transferred, position information (53) of relay points used to determine a route to the destination, and position information (52) of the last transferring vehicle. In the case where the host vehicle is not located in a predetermined range (CA) on the basis of the relay points, the data processing unit sets a first time as the predetermined standby time that becomes shorter as a distance between the position of the last transferring vehicle and the position of the host vehicle becomes longer, and in the case where the host vehicle is located in the predetermined range, the data processing unit sets a second time as the predetermined standby time that becomes longer as a distance between the position of the host vehicle and the position of the relay point becomes longer. According to the aspect, in the case where the vehicles located in a predetermined range (hereinafter, referred to as "relay range") on the basis of the relay points receive the transfer data, the vehicle located closer to the relay point can transfer the data first. For example, in the case where the center of a blind section is set as the relay point and a predetermined range centering on the intersection is set as the relay range, even if the relay range is a blind range and data cannot be transferred, there is a high possibility that data can be transferred and data can be efficiently transferred because the center of the intersection is an area with a relatively good view.

[2] (Data Transfer is not Performed in the Case where Distance Between Last Transferring Vehicle and Destination is Longer than that Between Host Vehicle and Destination)

In the communication equipment according to section 1, the data processing unit calculates a first distance between the position of the last transferring vehicle and the position of the destination through the relay points and a second distance between the position of the host vehicle and the position of the destination through the relay points, and if the second distance is longer than the first distance, the data processing unit stops the process of transmission. According to the aspect, there is a high possibility that data can be transferred along a route to the destination through the relay points.

[3] (Standby Time in Relay Range is Shorter than Standby Time Outside Relay Range)

In the communication equipment according to section 2, the second time is set shorter than the first time. According to the aspect, since the vehicle in the relay range initially transfers data prior to that outside the relay range, there is a high possibility that the data can be transferred along a route.

[4] (If the Same Vehicle Information is Received Again During Waiting for Transfer, Vehicle Information is not Transferred)

In the communication equipment according to any one of sections 1 to 3, in the case where another piece of transfer data including the same data as the data to be transferred included in the transfer data is received during waiting for the process of transmission of the transfer data, the transmission/reception unit stops the process of transmission. According to the aspect, since the same data to be transferred are prevented from being retransmitted, it is possible to suppress an increase in the amount of communications.

[5] (Information for Indicating Position of Host Vehicle)

In the communication equipment according to any one of sections 1 to 4, the data processing unit further generates host-vehicle information including position information of the host vehicle, and sets, as new transfer data, data to which the host-vehicle information is added in place of the position information of the last transferring vehicle in the received transfer data.

[6] (Data Information to be Transferred)

In the communication equipment according to any one of sections 1 to 5, the data to be transferred include position information of an emergency vehicle, position information of a general vehicle, or position information of a broken vehicle.

[7] (Information of Travelling Direction)

In the communication equipment according to any one sections 1 to 6, the position information of the last transferring vehicle further includes information for indicating the travelling direction of the last transferring vehicle, and the data processing unit determines whether or not to execute the process of transmission on the basis of the travelling direction of the last transferring vehicle and the travelling direction of the host vehicle. According to the aspect, even in the case where, for example, the vehicle running in the direction opposed to the travelling direction of the last transferring vehicle receives the transfer data, it is possible to prevent the vehicle that received the transfer data from transferring.

[8] (Communication Control Method)

In an inter-vehicle communication control method according to another representative embodiment of the present invention, data for indicating vehicle running conditions including data to be transferred, position information of a destination of the data to be transferred, position information of relay points used to determine a route to the destination, and position information of the last transferring vehicle are transmitted and received using communication control equipment (or a communication device) (100). The inter-vehicle communication control method includes: a first step (S401) of receiving the data for indicating the vehicle running conditions transferred by another vehicle; and a second step (S404) of calculating a first distance between the position of the last transferring vehicle that transferred the received data and the position of the destination through the relay points and a second distance between the position of the host vehicle and the position of the destination through the relay points after the first step. Further, the inter-vehicle communication control method includes: a third step (S406 and S410) of calculating a standby time to the transfer of the received data for indicating the vehicle running conditions on the basis of the position of the host vehicle and the data received in the first step, if the first distance calculated in the second step is shorter than the second distance; and a fourth step (S411) of transferring the data for indicating the vehicle running conditions to another vehicle after the standby time calculated in the third step passes. In the case where the host vehicle is not located in a predetermined range on the basis of the relay points, a first time is set as the predetermined standby time in the third step that becomes shorter as a distance between the position of the last transferring vehicle and the position of the host vehicle becomes longer (S411), and in the case where the host vehicle is located in the predetermined range, a second time is set as the predetermined standby time in the third step that becomes longer as a distance between the position of the host vehicle and the position of the relay point becomes longer (S406). According to the aspect, the effects and advantages same as those in sections 1 and 2 can be obtained.

[9] (If the Same Vehicle Information is Received Again During Waiting for Transfer, Vehicle Information is not Transferred)

In the inter-vehicle communication control method according to section 8, in the case where data including the same data as the data to be transferred are received from another vehicle before the standby time used to perform the fourth step passes, the fourth step is stopped (S408). According to the aspect, the effects and advantages same as those in section 4 can be obtained.

[10] (Communication System)

An inter-vehicle communication system (10) according to still another representative embodiment of the present invention includes: an antenna unit (107) that transmits and receives data for indicating vehicle running conditions; a sensor unit (109) that measures the position of the host vehicle; and a communication control unit (100) that performs a process of transmitting the data for indicating the vehicle running conditions to another vehicle after a time that is inversely proportional to a distance between the last transferring vehicle that transmitted the data and the host vehicle when the data for indicating the vehicle running conditions are received from another vehicle. In the case where the host vehicle is located in a blind range, the communication control unit performs a process of transmitting the data for indicating the vehicle running conditions to another vehicle after a time that is proportional to a distance between the position of the host vehicle and a center position of the blind range passes. According to the aspect, the vehicle located closer to the relay point can transfer the data first. Accordingly, data can be efficiently transferred even at a blind intersection, as similar to section 1.

2. Further Detailed Description of the Embodiments

The embodiment will be described in more detail.

First Embodiment

<Outline of Inter-Vehicle Communication System>

An inter-vehicle communication system according to the concrete embodiment of the present invention is shown in FIG. 1.

An inter-vehicle communication system 10 shown in FIG. 1 includes an antenna unit 107, communication equipment (or a communication device) 100, display equipment 108, in-vehicle sensor equipment 109, and a navigation system 110. In the inter-vehicle communication system 10, the communication equipment 100 receives, via the antenna unit 107, vehicle information (hereinafter, also referred to as "vehicle running information") such as the position, moving direction, and velocity of a vehicle and information (hereinafter, also referred to as "event information") showing that an emergency vehicle is coming close or the presence of an accident vehicle from another inter-vehicle communication system 10_A or the like, and displays information on the display equipment 108 on the basis of the received information. Alternatively, the communication equipment 100 controls the vehicle on the basis of the received information, and performs processes for providing the driver with information and for avoiding a collision accident. Further, the communication equipment 100 specifies the position or the like of the host vehicle on the map on the basis of information such as the position and moving direction of the host vehicle measured by the in-vehicle sensor equipment 109 and map information stored in the navigation system 110. Moreover, the communication equipment 100 generates the vehicle running information of the host vehicle and the event information to be transmitted to a designated destination.

As shown in FIG. 1, the communication equipment 100 includes storage equipment 101, a CPU 102, a memory unit 103, an input/output interface 104, a bus 105, and a wireless transmission/reception unit 106. The storage equipment 101, the CPU 102, the memory unit 103, and the input/output interface 104 are commonly coupled to the bus 105.

The storage equipment 101 is a storage medium such as an HDD (Hard Disk Drive), and stores various conditions used for determining a possibility of collision between vehicles, and programs and parameters used for determining a possibility of collision between vehicles in accordance with the conditions. The concrete content stored in the storage equipment 101 will be described later.

The CPU 102 is a computing device such as a processor, and performs overall control to analyze received packet information and to generate and communicate packet information. The CPU 102 reads the various programs stored in the storage equipment 101, and loads the same to the memory unit 103 (to be described later) to realize various functions in accordance with various commands described in the loaded programs. As function realization units realized by the CPU 102 and the read programs, for example, a communication processing unit 1100 for realizing processes of transmission and reception of the vehicle information and a vehicle information processing unit 1200 for executing processes of calculating a transfer standby time on the basis of the obtained vehicle information are shown in FIG. 1, for the purpose of explanation. The details of these units will be described later.

The memory unit 103 is a storage device such as a RAM (Random Access Memory), and temporarily stores the programs loaded by the CPU 102 and calculation results in program processing.

The input/output interface 104 is an interface, such as an interface card, for coupling the communication equipment 100 to the display equipment 108, the in-vehicle sensor equipment 109, and the navigation system 110.

The wireless transmission/reception unit 106 is coupled to the antenna unit 107, and transmits and receives the vehicle information to/from another vehicle via the antenna unit 107. For example, the wireless transmission/reception unit 106 periodically receives the vehicle running information of peripheral vehicles or other vehicles from roadside communication equipment, or transmits the vehicle running information of the host vehicle measured by the in-vehicle sensor equipment 109 to other vehicles and the roadside communication equipment. Accordingly, each vehicle recognizes the positions of peripheral vehicles.

The antenna unit 107 is used for both of transmission and reception. In the case where the antenna unit 107 outputs a transmission signal, the antenna unit 107 is switched to a transmission mode by the wireless transmission/reception unit 106 (to be described later). In the case where the antenna unit 107 receives a reception signal, the antenna unit 107 is switched to a reception mode by the wireless transmission/reception unit 106.

The display equipment 108 is configured using, for example, a liquid crystal display, and displays warning information or the like under the control of the communication equipment 100.

The in-vehicle sensor equipment 109 measures the vehicle running information of the host vehicle. The details thereof will be described later.

The navigation system 110 includes a map information holding unit 1400 (to be described later) where map information is stored.

<Communication Method by Inter-Vehicle Communication System>

A communication method between vehicles each having the inter-vehicle communication system 10 mounted will be described.

Figure 2:
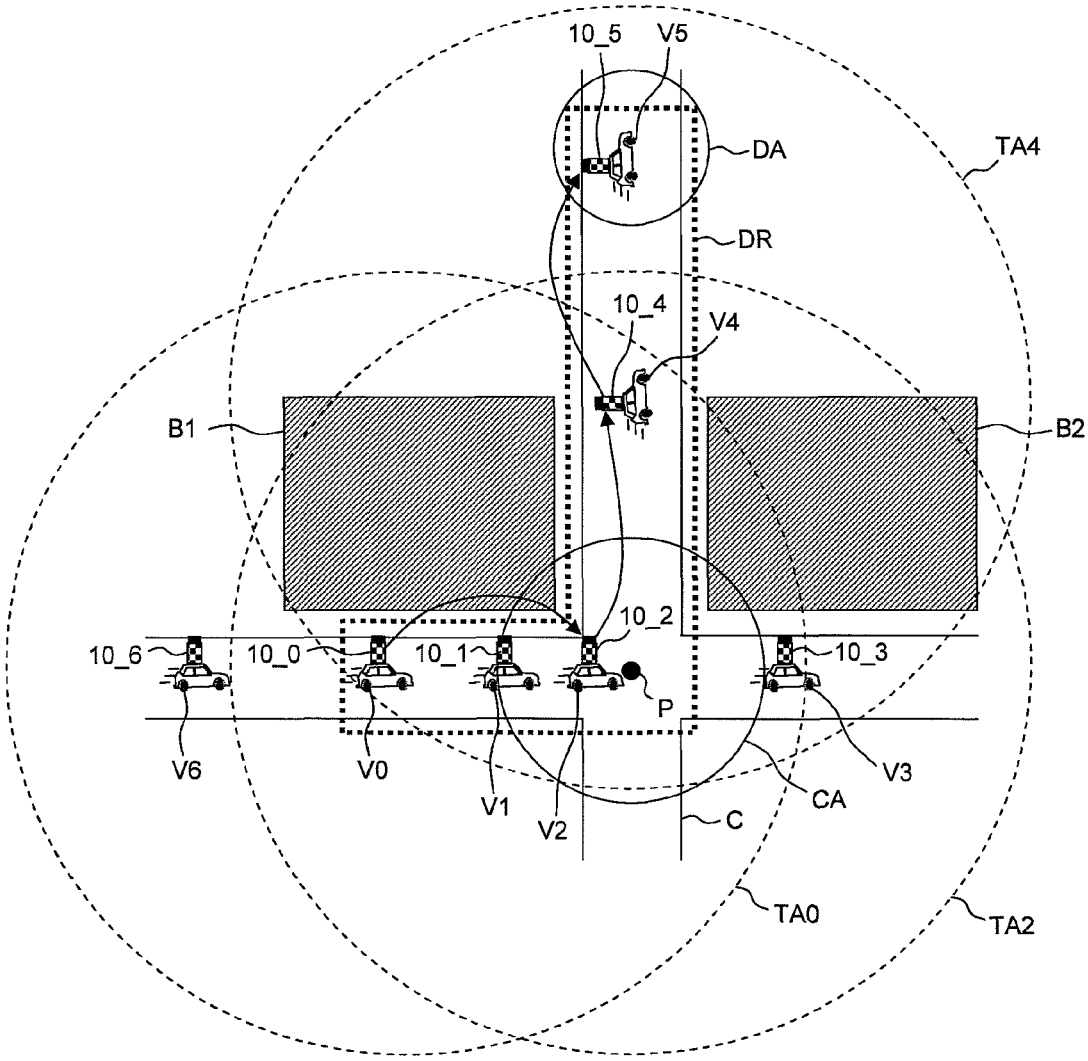
FIG. 2 is an explanation view for showing an outline of a communication method by an inter-vehicle communication system 10.

FIG. 2 is a diagram for showing an outline of a communication method by the inter-vehicle communication system 10 according to the first embodiment.

As shown in FIG. 2, a vehicle V0, a vehicle V1, a vehicle V2, a vehicle V3 and a vehicle V6, and a vehicle V4 and a vehicle V5 are running on roads which intersect with each other at a blind intersection C where buildings B1 and B2 that block radio waves are located. Inter-vehicle communication systems 10_0 to 10_6 each having the same function as the inter-vehicle communication system 10 are mounted in the vehicles V0 to V6, respectively. A transmittable range of information is set for each of the inter-vehicle communication systems 10_0 to 10_6. For example, in the case of the inter-vehicle communication system 10_0, information can be transmitted to the vehicles within a range represented by a referential sign TA0. FIG. 2 shows an example in which the inter-vehicle communication system 10_0 mounted in the vehicle V0 transmits the vehicle information to a transmission target range DA along a transmission route DR.

In FIG. 2, the vehicle V0 transmits the vehicle information including the vehicle running information of the host vehicle and the event information to the transmission target range DA. However, the transmission target range DA is located outside the transmittable range TA0 of the vehicle V0, and thus performs communications using multihop communications. Specifically, the vehicle V0 transmits the vehicle information to another vehicle located in the transmittable range TA0, and the vehicle serving as a relay vehicle that received the vehicle information transfers the vehicle information, so that the vehicle information can be transmitted to the transmission target range DA. At this time, the vehicle V0 transmits packet information obtained by converting, to a packet format, information (hereinafter, referred to as "destination range information") for indicating the position or the like of the transmission target range DA and information (hereinafter, referred to as "relay point information") for indicating the position or the like of a relay point used to designate the transmission route in addition to the vehicle information. The relay vehicle that received the packet information determines whether or not to transfer the packet information on the basis of the received packet information. In the case where the packet information is transferred, the relay vehicle starts to transfer the packet information after a predetermined time passes.

The determination on whether or not the vehicle that received the packet information transfers the packet information is made in accordance with the following method.

The relay vehicle that received the packet information compares a distance (hereinafter, referred to as "distance from the host vehicle") between the position of the host vehicle and the transmission target range DA through a relay point P with a distance (hereinafter, referred to as "distance from the last transferring vehicle) between the position of the last transferring vehicle that transmitted the packet information and the transmittable range DA through the relay point P. In the case where the distance from the host vehicle is shorter, the packet information is transferred. In the case where the distance from the host vehicle is longer, the packet information is not transferred. For example, in the case of FIG. 2, if the vehicles V1, V2, V3, and V6 received the packet information transmitted by the vehicle V0, the vehicle V6 does not transfer the packet information because the distance between the position of the vehicle V6 and the transmittable range DA through the relay point P is longer than that between the position of the vehicle V0 that transmitted the packet information and the transmittable range DA through the relay point P. Accordingly, it is possible to prevent all the vehicles that received the packet information from transferring, and to reduce the entire amount of communications. Further, the vehicle such as the vehicle V6 that is located farther from the transmission target range DA than the vehicle that transmitted the packet information is located outside the designated route DR in many cases. Such a vehicle does not transfer the packet information, so that there is a high possibility that a transfer along the route is realized and information can be efficiently transmitted.

Next, a transfer rule followed when the vehicle that determined to transfer the packet information transfers the same is as follows.

The vehicle that received the packet information starts to transfer after a predetermined time passes as described above. The standby time (hereinafter, referred to as "transfer standby time") from the time the packet information is received to the time the packet information is transferred is determined on the basis of the position of the vehicle that received the packet information. There are two methods of determining the transfer standby time which is selected on the basis of whether or not the relay vehicle is located within a relay range based on the relay point. Here, the relay point is set as a center point P of the intersection C, and the relay range is represented by a referential sign CA in FIG. 2. Hereinafter, the method of determining the transfer standby time will be described in detail.

Figure 3:
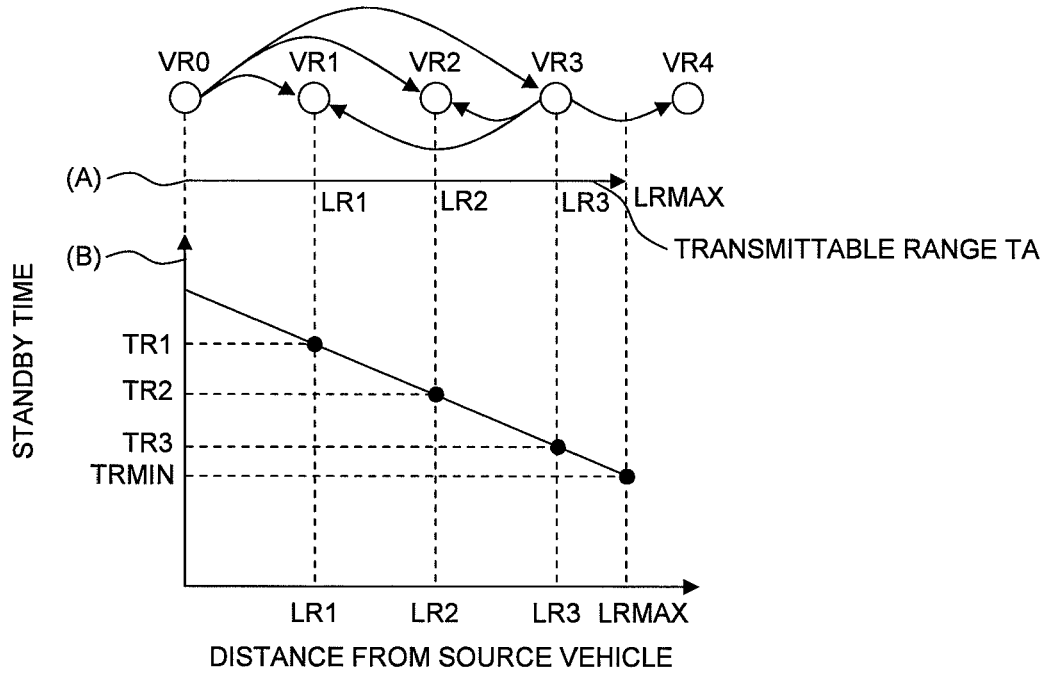
FIG. 3 is an explanation view for showing an example of a method of determining a transfer standby time in the case where a relay vehicle is located outside a relay range.

FIG. 3 is an explanation view for showing an example of the method of determining the transfer standby time in the case where the relay vehicle is located outside the relay range CA.

In the case where the relay vehicle is located outside the relay range CA, the transfer standby time is determined in accordance with the distance of each relay vehicle from the vehicle that transmitted the packet information (hereinafter, referred to as "transfer standby time determination process 1").

The diagram shown by a referential sign (A) of FIG. 3 shows a case in which the vehicle VR0, as a source vehicle of the packet information, transmits the packet information to the vehicles VR1 to VR3 located in the transmittable range TA, and the vehicles VR1 to VR3 that received the packet information transfer the same. The vehicles VR1 to VR3 are located apart from the vehicle VR0 that transmitted the packet information by distances LR1, LR2, and LR3, respectively. It should be noted that a distance LRMAX represents the maximum transmittable distance of the vehicle VR0.

The diagram shown by a referential sign (B) of FIG. 3 shows an example of a relation between the transfer standby time and the distance from the vehicle that transferred the packet information. As shown by the referential sign (B), the transfer standby times TR1 to TR3 of the respective relay vehicles VR1 to VR3 are determined on the basis of the distances of the relay vehicles from the vehicle VR0 that transmitted the packet information. The longer the distance becomes, the shorter the standby time becomes. Accordingly, the vehicle VR3 initially starts to transfer the packet information among those that received the packet information from the source vehicle VR0 in the case shown by the referential sign (A). With this configuration, the vehicle information can be transmitted to the destination range with the less number of transfers because the vehicle that located farthest from the source vehicle starts to transfer the packet information. Specifically, the vehicle information can be transmitted to the destination range in a short time.

On the other hand, the method of determining the transfer standby time in the case where the relay vehicle is located in the relay range CA is as follows.

Figure 4:
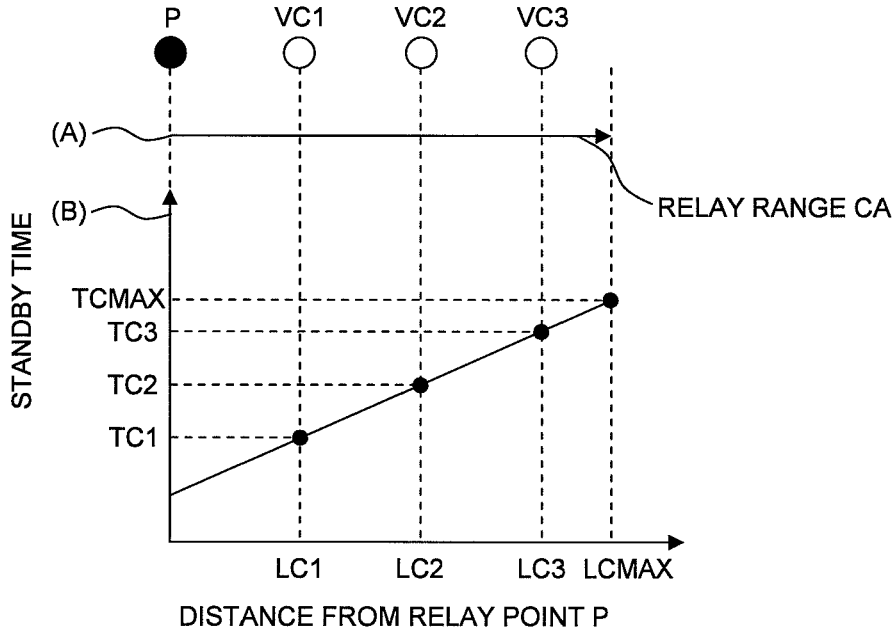
FIG. 4 is an explanation view for showing an example of the method of determining the transfer standby time in the case where the relay vehicle is located in the relay range.

FIG. 4 is an explanation view for showing an example of the method of determining the transfer standby time in the case where the relay vehicle is located in the relay range CA.

In the case where the relay vehicle is located in the relay range CA, the transfer standby time is determined on the basis of the distance of the relay vehicle from the relay point (hereinafter, referred to as "transfer standby time determination process 2").

The diagram shown by a referential sign (A) of FIG. 4 shows a case in which the relay vehicles VR1 to VR3 are located in the relay range CA. The vehicles VR1 to VR3 are located at the positions apart from the center point P of the relay range CA by distances LC1, LC2, and LC3, respectively. It should be noted that a distance LCMAX represents the maximum range of the relay range CA.

The diagram shown by a referential sign (B) of FIG. 4 shows an example of a relation between the transfer standby time and the distance from the center point P. As shown by the referential sign (B), the transfer standby times of the respective relay vehicles VR1 to VR3 are determined on the basis of the distances of the relay vehicles from the center point P of the relay range CA. The longer the distance becomes, the shorter the standby time becomes. Further, the transfer standby time determined by the transfer standby time determination process 2 is set shorter than that determined by the transfer standby time determination process 1. Specifically, a transfer standby time TCMAX in the distance LCMAX representing the maximum range of the relay range CA is shorter than a transfer standby time TRMIN in the maximum transmittable distance LRMAX of the vehicle VR0. Thereby, the vehicle located nearer the relay point P starts to transfer the packet information. Specifically, the vehicle located in the center of an area with a relatively-good view in a blind intersection can start to transfer the packet information, and thus there is a high possibility that the packet information can be successfully transferred.

When the transfer standby time is determined by any one of the methods, the relay vehicle starts to transfer the packet information after the transfer standby time passes. In the case where the same packet information is received again in the standby time, the process of the transfer is stopped. For example, in the referential sign (A) of FIG. 3, in the case where the vehicle VR3 transfers the packet information transmitted by the vehicle VR0 to the vehicles VR1, VR2, and VR4, the vehicles VR1 and VR2 stop the process of the transfer. Since the vehicle VR3 initially transferred the packet information received from the vehicle VR0, a decrease in the necessity of transferring the same packet information by the vehicles VR1 and VR2 is considered. As described above, the process of the transfer is stopped when the same packet information is received in the transfer standby time, and thus it is possible to prevent the amount of communications from increasing.

In FIG. 2, the transfer of the packet information in accordance with the transfer rule is as follows.

In the first place, the source vehicle V0 transmits the packet information to other vehicles located in the transmittable range TA0. In FIG. 2, the vehicle V4 is located in the transmittable range TA0 of the vehicle V0. However, the building B1 that blocks radio waves is present between the vehicle V0 and the vehicle V4, and thus there is a high possibility that the packet cannot be transmitted and received. In this case, it is assumed that the packet information is transmitted from the vehicle V0 to the vehicles V1, V2, V3, and V6 other than the vehicle V4.

Next, the vehicles V1, V2, V3, and V6 determine whether or not to transfer the received packet information. For example, the distance of the vehicle V6 to the transmission target range DA through the relay point P is longer than that of the source vehicle V0 as described above. Thus, the vehicle V6 does not transfer the packet information. Accordingly, the vehicles V1, V2, and V3 determine their standby times and perform the process of the transfer.

Next, the vehicles V1, V2, and V3 determine their transfer standby times.

Since the vehicles V1 and V2 are located in the relay range CA, the transfer standby times are determined by the transfer standby time determination process 2. On the other hand, since the vehicle V3 is located outside the relay range CA, the transfer standby time is determined by the transfer standby time determination process 1. The transfer standby time determined by the transfer standby time determination process 2 is set shorter than that determined by the transfer standby time determination process 1 as described above, so that the vehicles V1 and V2 initially start to transfer the packet information prior to the vehicle V3. Further, it can be found by the comparison of the positions of the vehicle V1 and the vehicle V2 that the vehicle V2 is located closer to the relay point P. Thus, the transfer standby time of the vehicle V2 is set shorter. Accordingly, the vehicle V2 initially starts to transfer the packet information among the vehicles V1, V2, and V3.

The vehicle V2 transfers the packet information, so that the vehicles V1, V3, and V4 located in a transmittable range TA2 of the vehicle V2 receive the packet information. Since the vehicles V1 and V3 have already received the same packet information in this case, the process of the transfer in the transfer standby time is stopped. On the other hand, since the vehicle V4 has not received the packet information from the vehicle V0 and the distance of the vehicle V4 to the transmission target range DA is shorter than that of the source vehicle V2, the process of the transfer is started. At this time, since the vehicle V4 is located outside the relay range CA, the transfer standby time is determined by the transfer standby time determination process 1. In addition, the transfer is executed after the transfer standby time passes, and the packet information is transferred to the vehicle V5 located in the transmission target range DA.

According to this configuration, since the vehicle V2 located near the center area with a relatively good view in the blind intersection initially transfers the packet information among those located near the intersection C, there is a high possibility that the packet information can be successfully transferred, and the packet information can be transferred to the transmission target range in a shorter time.

<Detailed Operation by Communication Equipment 100>

The above-described communications can be realized by control and execution of the communication equipment 100 on the basis of information of vehicle sensor equipment 109 and the navigation system 110.

Hereinafter, details of the vehicle sensor equipment 109, the navigation system 110, and the communication equipment 100 will be described.

Figure 5:
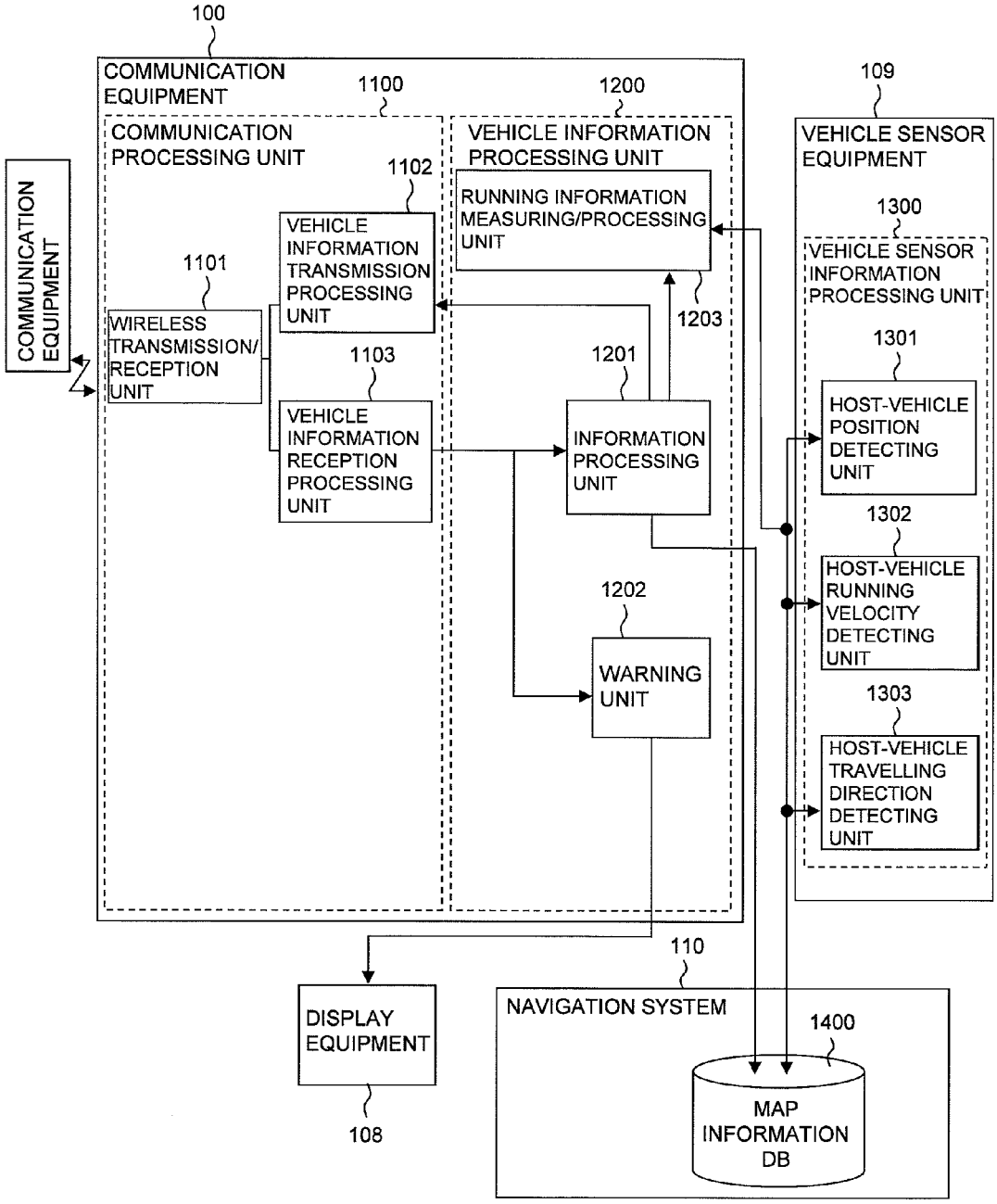
FIG. 5 is a block diagram for showing an example of functional configurations of communication equipment 100 and other equipment coupled to the communication equipment 100.

FIG. 5 is a block diagram for showing functional configurations of the communication equipment 100 and the display equipment 108 and the like coupled to the communication equipment 100.

In FIG. 5, the vehicle sensor equipment 109 includes a host-vehicle position detecting unit 1301 that detects the position of the host vehicle, a host-vehicle running velocity detecting unit 1302 that detects the running velocity of the host vehicle, and a host-vehicle travelling direction detecting unit 1303 that detects the travelling direction of the host vehicle. The host-vehicle position detecting unit 1301 is, for example, a global positioning system (GPS), and reads the current time from a timer (not shown) to measure the latitude and longitude of the host vehicle. The host-vehicle running velocity detecting unit 1302 is, for example, a speed sensor or a gyroscope. The gyroscope measures the acceleration and angle of the host vehicle, and the speed sensor measures the velocity of the host vehicle. The host-vehicle travelling direction detecting unit 1303 is, for example, a compass or a gyrocompass, and measures the moving direction of the host vehicle.

The navigation system 110 includes the map information holding unit 1400 that holds map information.

FIG. 6 is an explanation view for showing an example of a format of the map information stored in the map information holding unit 1400.

As shown in FIG. 6, the map information holding unit 1400 holds information of coupling points each indicating an intersection or a curve that relays the packet information. The information of coupling points includes, for example, a coupling point ID (Identifier) for uniquely specifying the coupling point indicating an intersection or a curve, coupling point latitude information 1 for indicating the latitude of the position of each coupling point, coupling point latitude information 2 for indicating whether the coupling point latitude information 1 is of the north latitude or the south latitude, coupling point longitude information 1 for indicating the longitude of the position of each coupling point, and coupling point longitude information 2 for indicating whether the coupling point longitude information 1 is of the east longitude or the west longitude. Further, the information of coupling points includes a coupling point ID of another coupling point coupled to the coupling point, distance information between coupling points for indicating distances between the coupling point and others, and information of the size of the coupling point. The meaning of the content shown in FIG. 6 is as follows. The coupling point with a coupling point ID "1" and a radius of 5 m is located at "4807.038247" (north latitude) and "01131.324523" (east longitude). The coupling point 1 is coupled to a coupling point 2, a coupling point 3, and a coupling point 4, the distance between the coupling point 1 and the coupling point 2 is 30 m, and the distance between the coupling point 1 and the coupling point 4 is 40 m. As described above, a road is defined as a line section coupling two points in the map information stored in the map information holding unit 1400.

The communication processing unit 1100 and the vehicle information processing unit 1200 of the communication equipment 100 shown in FIG. 5 are function realization units realized by the CPU 102 executing the programs read from the storage equipment 101 as described above.

The communication processing unit 1100 includes a wireless transmission/reception processing unit 1101, a vehicle information transmission processing unit 1102, and a vehicle running information reception processing unit 1103.

The wireless transmission/reception processing unit 1101 outputs packet information received by the wireless transmission/reception unit 106 through the antenna unit 107 to the vehicle information reception processing unit 1103.

The vehicle information reception processing unit 1103 converts the vehicle information related to the obtained packet information into a format that is readable for the vehicle information processing unit 1200, and the converted vehicle information is output to the vehicle information processing unit 1200.

The vehicle information transmission processing unit 1102 converts the vehicle information provided from the vehicle information processing unit 1200 into a packet format. The vehicle information transmission processing unit 1102 counts the transfer standby time set by the vehicle information processing unit 1200, and outputs the converted packet information related to the vehicle information to the wireless transmission/reception processing unit 1101 after the transfer standby time passes. The wireless transmission/reception processing unit 1101 that received the packet information provides the wireless transmission/reception unit 106 with the packet information, and allows the wireless transmission/reception unit 106 to perform a process of transmission.

Here, a format of the packet information related to the vehicle information will be described.

FIG. 7 is an explanation view for showing an example of a packet format of the vehicle information.

As shown in FIG. 7, the vehicle information includes, for example, source vehicle information 50 that is information as a transmission target of the vehicle information, destination range information 51 that designates a destination, transferring vehicle running information 52 of the vehicle that lastly transferred the packet information, and relay point information 53 that is information indicating relay points. Details of these pieces of information are as follows.

The source vehicle information 50 includes a source vehicle ID (Identifier) for uniquely specifying the vehicle that transmitted the vehicle information, information (service type ID) for indicating a service type provided as the event information, and vehicle running information of the source vehicle. The service type ID is an identification ID for showing that, for example, the source vehicle is an emergency vehicle or the like.

Figures 8, 10:
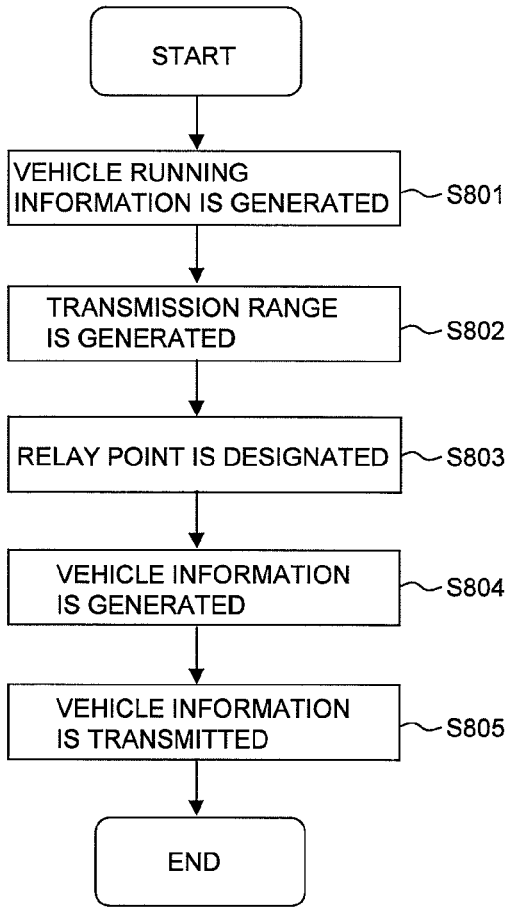
FIG. 8 is an explanation view for showing an example of a service type ID.
FIG. 10 is a flowchart for showing generation and transmission processes of the vehicle information by the information processing unit 1201.

FIG. 8 is an explanation view for showing an example of the service type ID.

In FIG. 8, a service type ID "1" represents to provide the position information of an emergency vehicle, a service type ID "2" represents to provide the position information of a general vehicle, and a service type ID "3" represents to provide the position information of an accident vehicle.

Further, the vehicle running information of the source vehicle included in the source vehicle information 50 includes, for example, the information as shown in FIG. 5. Specifically, the vehicle running information of the source vehicle includes source vehicle latitude information 1 for indicating the latitude where the source vehicle is located and source vehicle latitude information 2 for indicating whether the source vehicle latitude information 1 is of the north latitude (N) or the south latitude (S). Further, the vehicle running information of the source vehicle includes source vehicle longitude information 1 for indicating the longitude where the source vehicle is located and source vehicle longitude information 2 for indicating whether the source vehicle longitude information 1 is of the east longitude (E) or the west longitude (W). Further, the vehicle running information of the source vehicle includes the moving direction and running velocity of the source vehicle, and a time when the source vehicle measured the position information.

The destination range information 51 includes, for example, transmission range latitude information 1 for indicating the latitude of the center point of the destination range, transmission latitude information 2 for indicating whether the transmission range latitude information 1 is of the north latitude or the south latitude, transmission range longitude information 1 for indicating the longitude of the center point of the destination range, and transmission range longitude information 2 for indicating whether the transmission range longitude information 1 is of the east longitude or the west longitude. Further, the destination range information 51 includes the size of the destination range and a diagram of the transmission range for representing the shape of the transmission range. For example, the shape of the destination range is represented by a circle and the size of the destination range is determined on the basis of the distance from the center of the destination range in the case of FIG. 7

The transferring vehicle running information 52 includes, for example, a transferring vehicle ID for uniquely specifying the vehicle that lastly transferred the vehicle information, transferring vehicle latitude information 1 for indicating the latitude where the transferring vehicle is located, transferring vehicle latitude information 2 for indicating whether the transferring vehicle is located at the north latitude or the south latitude, transferring vehicle longitude information 1 for indicating the longitude where the transferring vehicle is located, and transferring vehicle longitude information 2 for indicating whether the transferring vehicle is located at the east longitude or the west longitude.

In the relay point information 53, information for indicating the relay points used to determine a route on which the vehicle information is transferred is stored for each relay point. For example, n pieces of position information corresponding to the number of relay points are stored to indicate intersections or curves serving as relay points. The position information of each relay point includes relay point latitude information 1 for indicating the latitude of the center point of the relay point, relay point latitude information 2 for indicating whether the relay point latitude information 1 is of the north latitude or the south latitude, relay point latitude information 1 for indicating the longitude of the center point of the relay point, and relay point latitude information 2 for indicating whether the relay point latitude information 1 is of the north latitude or the south latitude. Further, the position information of each relay point includes the size of the relay point and a diagram for representing the shape of the relay range.

The content represented by the packet information shown in FIG. 7 is as follows. The source vehicle whose vehicle ID is registered as "1000" is located at "4807.038247" (north latitude) and "01131.324523" (east longitude) at a positioning time "12:35:19.00", and is running at 60 km/h in a direction of 60 degrees relative to an east longitude of 90 degrees (north direction) from an east longitude of 0 degree. Further, in order to provide the position information of an emergency vehicle, the source vehicle transmitted the position information to the destination range defined by a circular shape with a center point of "4807.038248" (north latitude) and "01131.324524" (east longitude) and with a radius of 5 m while specifying N relay points including one defined by a circular shape with a center point of "4807.038250" (north latitude) and "01131.3245230" (east longitude) and with a radius of 5 m. Further, the information represents vehicle information that was transferred by the transferring vehicle whose vehicle ID is registered as "999" at "4807.038249" (north latitude) and "01131.324525" (east longitude).

The vehicle information processing unit 1200 includes information processing unit 1201, a warning unit 1202, and a running information measuring/processing unit 1203.

The warning unit 1202 calculates the possibility of collision on the basis of the vehicle information received from the vehicle information reception processing unit 1103, and generates information for giving a warning to the driver, if needed, to display warning information while controlling the display equipment 108. For example, in the case where the vehicle V2 received the vehicle information from the vehicle V1 in the case of FIG. 2 and it is determined that the possibility of collision with the vehicle V1 is high, the warning unit gives a warning while displaying the possibility on the display equipment 108.

The running information measuring/processing unit 1203 controls a vehicle sensor information processing unit 1300 to obtain the vehicle running information such as the position, running velocity, and travelling direction of the host vehicle measured by the host-vehicle position detecting unit 1301, the host-vehicle running velocity detecting unit 1302, and the host-vehicle travelling direction detecting unit 1303, and holds a measurement result in a storage area such as a register (not shown). The running information measuring/processing unit 1203 periodically obtains and holds the vehicle running information of the host vehicle. However, the running information measuring/processing unit 1203 may obtain and hold the vehicle running information of the host vehicle from the vehicle sensor information processing unit 1300 on the basis of a processing request of the information processing unit 1201.

When receiving the vehicle information from the vehicle information reception processing unit 1103, the information processing unit 1201 determines the necessity of the transfer of the vehicle information to other vehicles. In the case where it is determined that the transfer is needed, the transfer standby time is calculated, the calculated transfer standby time is set at the vehicle information transmission processing unit 1102, and the vehicle information to be transferred is provided. Specifically, the information processing unit 1201 reads the host-vehicle running information while referring to the vehicle running information of the host vehicle stored by the vehicle information measuring/processing unit 1203. Next, on the basis of the received vehicle information and the host-vehicle running information, the distance from the host vehicle is compared with that from the last transferring vehicle to determine whether or not to transfer. In the case where it is determined to transfer, the transfer standby time is calculated by the transfer standby time determination process 1 or the transfer standby time determination process 2. Then, the information processing unit 1201 provides the vehicle information transmission processing unit 1102 with the running information as the transfer target, and the calculated transfer standby time is set.

Further, the information processing unit 1201 designates the destination range to perform a process of transmitting the vehicle information. Specifically, the information processing unit 1201 determines the destination and relay points while referring to the map information holding unit 1400, and generates the running information as shown in FIG. 7 to be provided to the vehicle information transmission processing unit 1102.

<Flow of Transfer Process of Vehicle Information)

A flow of transfer processes of the received vehicle information by the information processing unit 1201 will be described in detail using FIG. 9.

Figure 9:
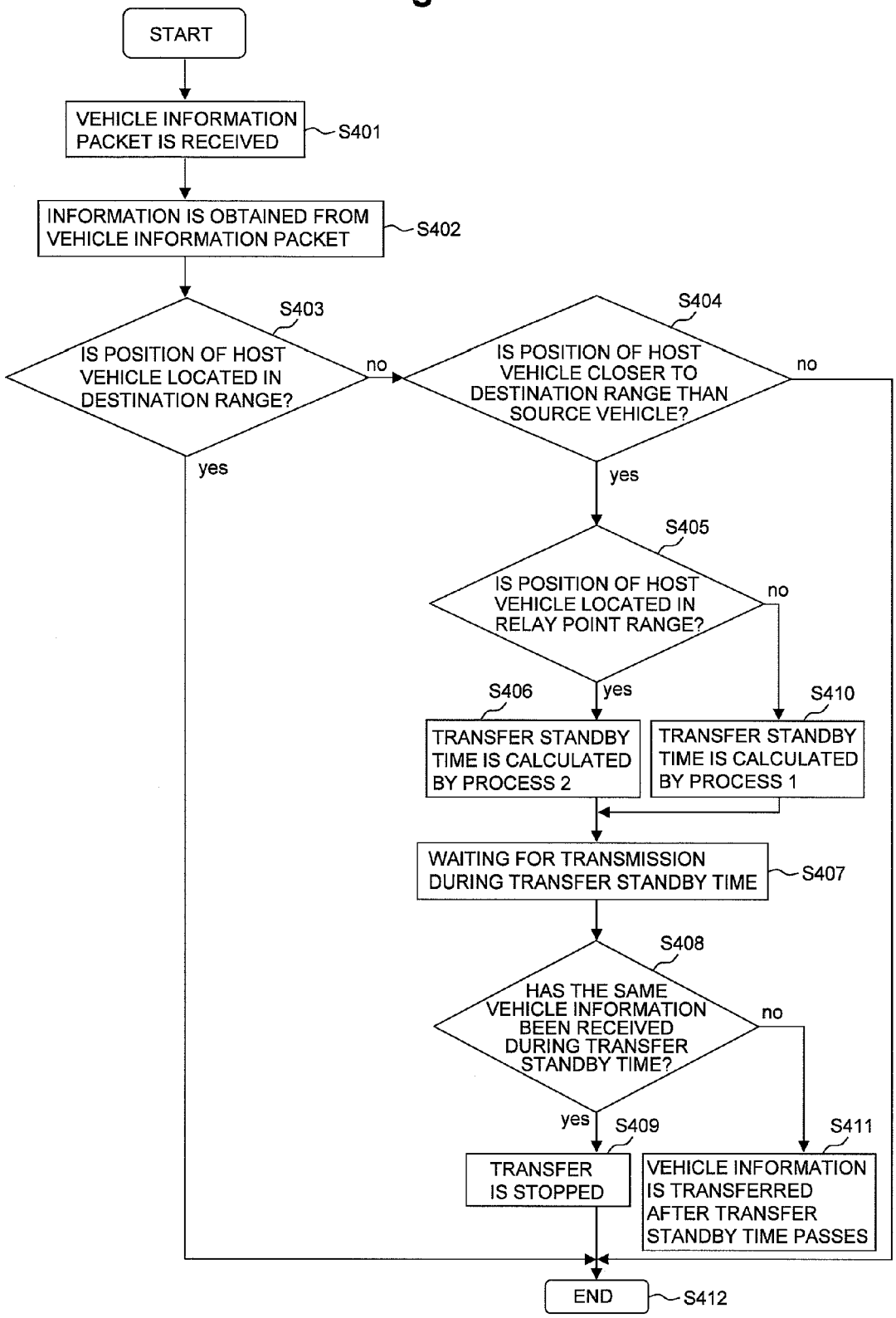
FIG. 9 is a flowchart for showing transfer processes of the vehicle information by an information processing unit 1201.

FIG. 9 is a flowchart for showing transfer processes of the vehicle information by the information processing unit 1201.

In the first place, when the wireless transmission/reception unit 106 receives the packet information related to the vehicle information via the antenna unit 107, the received packet information is provided to the vehicle information reception processing unit 1103 via the wireless transmission/reception processing unit 1101 (S401). The vehicle information reception processing unit 1103 converts the received packet information related to the vehicle information from the packet format to a format that is readable for the information processing unit 1201, and the converted vehicle information is provided to the information processing unit 1201 (S402). The information processing unit 1201 that received the vehicle information determines whether or not the host vehicle is located in the destination range (S403). Specifically, the information processing unit 1201 makes the determination by comparing the running information of the host vehicle with the received vehicle information while referring to the running information of the host vehicle stored in a register or the like by the running information measuring/processing unit 1203. For example, the determination on whether or not the host vehicle is located in the destination range determined on the basis of the destination range latitude information 1, the destination range longitude information 1, the size of the destination range and the diagram of the destination range that are information of the destination range shown in FIG. 7 is made using the vehicle latitude information and vehicle longitude information included in the running information of the host vehicle. In the case where it is determined that the host vehicle is located in the destination range in Step 403, it is determined that the vehicle information transmitted from the source vehicle has reached the destination range, and the transfer process is terminated (S412).

On the other hand, in the case where it is determined that the host vehicle is not located in the destination range, it is determined whether or not the received vehicle information needs to be transferred (S404). Specifically, the information processing unit 1201 calculates the distance from the host vehicle and the distance from the last transferring vehicle for comparison on the basis of the running information of the host vehicle and the received vehicle information. For example, the information processing unit 1201 calculates, as the distance from the host vehicle, the distance of the transfer route obtained by coupling the position of the host vehicle specified using the vehicle latitude information and vehicle longitude information of the host vehicle, the position of the destination range specified using the destination range latitude information and the destination range longitude information, and the positions of N relay points specified using the relay point latitude information and the relay point longitude information for each relay point. Further, the information processing unit 1201 calculates, as the distance from the last transferring vehicle, the distance of the transfer route obtained by coupling the position of the last transferring vehicle specified using the transferring vehicle latitude information and transferring vehicle longitude information of the last transferring vehicle, the position of the destination range, and the positions of N relay points. Then, the information processing unit 1201 compares the calculated distances with each other to determine whether or not the host vehicle is located nearer the destination range than the last vehicle. In the case where the result shows that the host vehicle is located nearer the destination range than the last vehicle, the information processing unit 1201 determines to transfer, and the flow proceeds to Step 405. On the other hand, in the case where the result shows that the host vehicle is not located nearer the destination range than the last vehicle, the information processing unit 1201 determines not to transfer, and the transfer process is terminated (S412).

In the case where the information processing unit 1201 determines to transfer the received vehicle information in Step 404, the information processing unit 1201 determines whether or not the host vehicle is located in the relay point ranges (S405). Specifically, the information processing unit 1201 makes the determination by comparing the running information of the host vehicle with the received vehicle information. For example, the determination on whether or not the host vehicle is located in any one of N relay point ranges specified using the relay point latitude information, the relay point longitude information, and the size of the relay point that are information of the relay point range shown in FIG. 7 is made using the vehicle latitude information and the vehicle longitude information included in the running information of the host vehicle. In the case where the result shows that the host vehicle is located in any one of the relay point ranges, the transfer standby time is calculated by the transfer standby time determination process 2 (S406). On the other hand, in the case where it is determined that the host vehicle is not located in any one of the relay point ranges, the transfer standby time is calculated by the transfer standby time determination process 1 (S410).

An example of the calculation method of the transfer standby time by the transfer standby time determination process 2 in Step 406 will be shown below. The transfer standby time can be obtained using, for example, an equation "$Ts=\alpha X$" wherein Ts represents the transfer standby time and X represents the distance between the center point of the relay range where the host vehicle is located and the position of the host vehicle. Here, α represents a transforming constant that is set in advance. According to this equation, the longer the distance X becomes, the longer the transfer standby time Ts is set.

An example of the calculation method of the transfer standby time by the transfer standby time determination process 1 in Step 410 will be shown below. The transfer standby time can be obtained using, for example, an equation "Ts=β/Y" wherein Ts represents the transfer standby time and Y represents the distance between the center point of the relay range where the host vehicle is located and the position of the host vehicle. Here, β represents a transforming constant that is set in advance. According to this equation, the longer the distance Y becomes, the shorter the transfer standby time Ts is set.

The information processing unit 1201 generates new running information to which the vehicle ID and the vehicle running information of the host vehicle are added in Step 406 or Step 410 in place of the transferring vehicle running information 52 of the last transferring vehicle in the received running information. Then, the information processing unit 1201 sets the calculated transfer standby time at the vehicle information transmission processing unit 1102, and provides the vehicle information transmission processing unit 1102 with the generated new running information.

The vehicle information transmission processing unit 1102 that received the running information from the information processing unit 1201 converts the vehicle information into a packet format. Then, the vehicle information transmission processing unit 1102 starts to count the set transfer standby time and waits until the transfer is started (S407). The vehicle information transmission processing unit 1102 confirms whether or not the wireless transmission/reception processing unit 1101 has received the source vehicle information 50 same as the vehicle information to be transferred during waiting for the transfer (S408).

In the case where it is confirmed that the wireless transmission/reception processing unit 1101 has received the vehicle information 50 of the same source vehicle in Step 408, the vehicle information transmission processing unit 1102 stops to count and resets the transfer standby time, and the generated new vehicle information is discarded (S409) to terminate the transfer process (S412).

On the other hand, in the case where it is confirmed that the wireless transmission/reception processing unit 1101 has not received the vehicle information 50 of the same source vehicle during waiting for the transfer, the packet information related to the new vehicle information is output to the wireless transmission/reception processing unit 1101 after the transfer standby time passes, and is transferred to other vehicles via the wireless transmission/reception unit 106 (S411). Then, a series of transfer processes are completed (S412).

<Flow from Generation of Vehicle Information to Transmission of the Same>

Next, a process in which the communication equipment 100 generates and transmits the vehicle information while designating the destination range and the relay range will be described using FIG. 10.

FIG. 10 is a flowchart for showing generation and transmission processes of the vehicle information by the information processing unit 1201.

In the first place, the running information measuring/processing unit 1203 obtains information such as the position, running velocity, and travelling direction of the host vehicle measured by the host-vehicle position detecting unit 1301, the host-vehicle running velocity detecting unit 1302, and the host-vehicle travelling direction detecting unit 1303, and generates the vehicle running information on the basis of the received information to be stored in a storage area such as a register (S801).

The information processing unit 1201 determines the position, size and diagram of the destination range while referring to the map information stored in the map information holding unit 1400 of the navigation system 110, and generates the destination range information 51 shown in FIG. 7 (S802).

Next, the information processing unit 1201 determines the transfer route to the destination range and the relay points along the route while referring to the map information (S803). Specifically, the transfer route is determined first, and then the relay points on the determined transfer route are determined. For example, the information processing unit 1201 reads information of the coupling points on the route while referring to the map information of the map information storage unit 1400, and generates the relay point information 53 shown in FIG. 7 by using the coupling points as relay points. The transfer route may be determined on the basis of the information selected by a driver referring to the navigation system 110, or may be a route to a destination of the host vehicle that is set in advance at the navigation system 110.

Thereafter, the information processing unit 1201 generates the running information on the basis of the information generated in Steps 801 to 803, and provides the vehicle information transmission processing unit 1102 with the running information (S804). Specifically, the information processing unit 1201 generates the source vehicle information 50 shown in FIG. 7 by adding the vehicle ID and service type ID of the host vehicle to the vehicle running information generated in Step 801. Then, the vehicle information of the host vehicle is generated using the generated vehicle information 50 of the host vehicle, the destination range information 51 and the relay point information 53 generated in Step 802 and Step S803, and the transferring vehicle running information 52 generated using the vehicle running information of the host vehicle, and is provided to the vehicle information transmission processing unit 1102. It should be noted that in the case where the transferring vehicle running information 52 shown in FIG. 7 is transmitted by the source vehicle, the information is the same as that included in the source vehicle information 50, and thus the vehicle does not need to generate the transferring vehicle running information 52 at the time of transmission.

The vehicle information transmission processing unit 1102 converts the vehicle information received from the information processing unit 1201 into the packet format shown in FIG. 5, and provides the wireless transmission/reception processing unit 1101 with the converted vehicle information, so that the vehicle information is transmitted to other vehicles via the wireless transmission/reception unit 106 (S905).

According to the inter-vehicle communication system of the first embodiment described above, the relay points are set when the vehicle information is transmitted to a destination while being transferred by other vehicles, so that there is a high possibility that the vehicle information can be transferred along a route to the destination through the relay points. Further, in the case where the vehicles that relay and transfer the vehicle information are located in the designated relay range, the vehicle located closest to the relay point transfers the data first. Accordingly, even if the relay range is a blind intersection, there is a high possibility that the data can be transferred, and the data can be efficiently transferred. Further, in the case where information same as the vehicle information to be transferred is received, the transfer process is stopped to prevent the retransfer of the vehicle information, so that the amount of communications can be prevented from increasing.

The invention achieved by the inventers has been concretely described on the basis of the embodiment. However, it is obvious that the present invention is not limited to the embodiment, but may be variously changed without departing from the scope of the invention.

For example, the determination on whether or not to transfer the received vehicle information in Step 404 of FIG. 9 is made by comparing the distance from the host vehicle with the distance from the last transferring vehicle by the information processing unit 1201. However, the present invention is not limited thereto. For example, the information processing unit 1201 may specify the transfer route on the basis of the position information of the source vehicle, the position information of the relay range, and the position information of the destination range to determine whether or not the host vehicle is located on the transfer route. Then, in the case where the host vehicle is not located on the transfer route, the vehicle information is not transferred. In the case where the host vehicle is located on the transfer route, Step 404 is executed. Accordingly, there is a high possibility that the data can be transferred along the transfer route. Further, it is also possible to determine whether or not to transfer on the basis of the information of the running direction of the host vehicle in Step 404 of FIG. 9. For example, information for indicating the travelling direction of the transferring vehicle is stored in the transferring vehicle information 52, so that the vehicle that received the information compares the travelling direction of the last transferring vehicle with the travelling direction of the host vehicle. If the travelling directions are opposite to each other, the information is not transferred.

Further, the vehicle ID and the vehicle running information of the last transferring vehicle are included in the transferring vehicle information 52 in FIG. 7. However, the present invention is not limited thereto, but only the vehicle ID of the last transferring vehicle may be included in the transferring vehicle information 52. For example, in addition to the vehicle information, each vehicle periodically transmits and receives the vehicle ID and position information of another vehicle located in the transmittable and receivable range. Accordingly, in the case where the communication equipment 100 receives the vehicle information, there is a high possibility that the position information or the like of the vehicle that transferred the vehicle information can be specified if only the last transferring vehicle ID can be known.

The first embodiment has been described using an example in which the communication equipment 100 mounted in each vehicle transfers the information. However, the present invention is not limited thereto, but the communication equipment 100 of a roadside base station installed on a road or at an intersection may transfer the information in accordance with the transfer rule. Accordingly, it is possible to obtain the effects and advantages similar to those obtained by the communication equipment mounted in each vehicle.

Further, the first embodiment has been described using an example in which the warning unit 1202 displays information on the display equipment 108 on the basis of the received vehicle information to give a warning to the driver. However, the present invention is not limited thereto, but the warning unit 1202 may give a warning to the driver by controlling an audio output device such as a speaker, or by vibrating a vibrator or the like.

It should be noted that there has been described an example in which the running information is described in the NMEA-0183 format (Global Positioning System Fix Data) used in the GPS in FIG. 6 and FIG. 7. However, the present invention is not limited thereto, but any format may be used as long as the running information of each vehicle can be described. For example, the running information may be defined using a coordinate system such as a geocentric coordinate system centering on the earth.

What is claimed is:

1. A communication device comprising:

a transmission/reception unit that receives transfer data for indicating vehicle running conditions, and performs a process of transmitting the transfer data after passage of a standby time following receipt of the transfer data; and a data processing unit that performs a process of calculating the standby time on the basis of the position of a host vehicle and the received transfer data, wherein the transfer data for indicating the vehicle running conditions comprise data to be transferred, position information of a destination of the data to be transferred, position information of relay points used to determine a route to the destination, and position information of a last transferring vehicle, and wherein, in the case where the host vehicle is not located in a predetermined range on the basis of the relay points, the data processing unit sets a first time as the standby time that becomes shorter as a distance between the position of the last transferring vehicle and the position of the host vehicle becomes longer, and in the case where the host vehicle is located in the predetermined range, the data processing unit sets a second time as the standby time that becomes longer as a distance between the position of the host vehicle and the position of a relay point becomes longer.

2. The communication device according to claim 1, wherein the data processing unit calculates a first distance between the position of the last transferring vehicle and the position of the destination through the relay points and a second distance between the position of the host vehicle and the position of the destination through the relay points, and if the second distance is longer than the first distance, the data processing unit stops the process of transmission.

3. The communication device according to claim 2, wherein the second time is set shorter than the first time.

4. The communication device according to claim 2, wherein in the case where another piece of transfer data comprising the same data as the data to be transferred comprised in the transfer data is received during waiting for the process of transmission of the transfer data, the transmission/reception unit stops the process of transmission.

5. The communication device according to claim 2, wherein the data processing unit further generates host-vehicle information comprising position information of the host vehicle, and sets, as new transfer data, data to which the host-vehicle information is added in place of the position information of the last transferring vehicle in the received transfer data.

6. The communication device according to claim 2, wherein the data to be transferred comprise position information of an emergency vehicle, position information of a general vehicle, or position information of a broken vehicle.

7. The communication device according to claim 2, wherein the position information of the last transferring vehicle further comprises information for indicating the travelling direction of the last transferring vehicle, and wherein the data processing unit determines whether or not to execute the process of transmission on the basis of the travelling direction of the last transferring vehicle and the travelling direction of the host vehicle.

8. An inter-vehicle communication control method for transmitting and receiving, using communication control equipment, data for indicating vehicle running conditions comprising data to be transferred, position information of a destination of the data to be transferred, position information of relay points used to determine a route to the destination, and position information of the last transferring vehicle, the method comprising:

a first step of receiving the data for indicating the vehicle running conditions transferred by another vehicle;

a second step of calculating, after the first step, a first distance between the position of the last transferring vehicle that transferred the received data and the position of the destination through the relay points and a second distance between the position of the host vehicle and the position of the destination through the relay points;

a third step of calculating a standby time following receipt of the received data to the transfer of the received data for indicating the vehicle running conditions on the basis of the position of the host vehicle and the data received in the first step, if the first distance calculated in the second step is shorter than the second distance; and a fourth step of transferring the data for indicating the vehicle running conditions to another vehicle after the standby time calculated in the third step passes, wherein in the case where the host vehicle is not located in a predetermined range on the basis of the relay points, a first time is set as the standby time in the third step that becomes shorter as a distance between the position of the last transferring vehicle and the position of the host vehicle becomes longer, and in the case where the host vehicle is located in the predetermined range, a second time is set as the standby time in the third step that becomes longer as a distance between the position of the host vehicle and the position of the relay point becomes longer.

9. The inter-vehicle communication control method according to claim 8, wherein in the case where data comprising the same data as the data to be transferred are received from another vehicle before the standby time used to perform the fourth step passes, the fourth step is stopped.

* * * * *